US006789391B2

(12) United States Patent
Graham et al.

(10) Patent No.: US 6,789,391 B2
(45) Date of Patent: Sep. 14, 2004

(54) MODULAR APPARATUS AND METHOD FOR SHIPPING SUPER FROZEN MATERIALS

(76) Inventors: B. Eric Graham, 77A Jerden's La., Rockport, MA (US) 01966; Stephen A. McCormick, 24 Pebble Ridge Rd., Warrington, PA (US) 18976

( * ) Notice: Subject to any disclaimer, the term of this patent is extended or adjusted under 35 U.S.C. 154(b) by 0 days.

(21) Appl. No.: 10/147,692

(22) Filed: May 17, 2002

(65) Prior Publication Data

US 2003/0041601 A1 Mar. 6, 2003

Related U.S. Application Data

(60) Provisional application No. 60/292,298, filed on May 21, 2001.

(51) Int. Cl.[7] ..... F17C 7/02; F25B 41/04; F25D 17/02

(52) U.S. Cl. ..... 62/52.1; 62/223; 62/64

(58) Field of Search ..... 62/223, 64, 371, 62/45.1, 50.3, 239, 52.1, 384, 532, 373, 62

(56) References Cited

U.S. PATENT DOCUMENTS

| | | | | |
|---|---|---|---|---|
| 3,230,726 A | | 1/1966 | Berner et al. | |
| 3,695,056 A | | 10/1972 | Glynn et al. | |
| 4,033,140 A | * | 7/1977 | Klee et al. | 62/223 |
| 4,294,079 A | | 10/1981 | Benson | |
| 4,344,291 A | | 8/1982 | Tyree, Jr. et al. | |
| 4,399,658 A | | 8/1983 | Nielsen | |
| 4,448,029 A | | 5/1984 | Keller | |
| 4,502,293 A | | 3/1985 | Franklin, Jr. | |
| 4,576,010 A | * | 3/1986 | Windecker | 62/64 |
| 4,580,411 A | | 4/1986 | Orfitelli | |
| 4,640,460 A | | 2/1987 | Franklin, Jr. | |
| 4,761,969 A | | 8/1988 | Moe | |
| 4,784,678 A | | 11/1988 | Rudick et al. | |
| 4,825,666 A | | 5/1989 | Saia, III | |
| 4,835,975 A | * | 6/1989 | Windecker | 62/45.1 |
| 4,891,954 A | | 1/1990 | Thomsen | |
| 4,947,658 A | | 8/1990 | Wheeler et al. | |
| 4,976,112 A | | 12/1990 | Roberts et al. | |

(List continued on next page.)

FOREIGN PATENT DOCUMENTS

| | | |
|---|---|---|
| EP | 0717246 A1 | 6/1996 |
| GB | 2074300 A | 10/1981 |
| JP | 48-68552 | 9/1973 |
| JP | 56-82051 | 2/1986 |

OTHER PUBLICATIONS

Installation and Operating Manual– Removeable Baffle End to Suit Insulated Shipping Container (c)2000 Cryo–Chem PTY LTD, Victoria Australia.*

Installation and Operating Manual—Removeable Baffle End To Suit Insulated Shipping Container.

Food and Drug Administration's (FDA) "Fish and Fishery Products Hazards and Controls Guidance".

The Pallet Reefer Company, Pallet Reffer, The Coolest Technology, in *Refrigeration* Since the *Ice Age*.

*Primary Examiner*—William C. Doerrler
(74) *Attorney, Agent, or Firm*—Sampson & Associates, P.C.

(57) ABSTRACT

An apparatus and method is provided for freezing, storing, and/or shipping products, in particular fish, at super-frozen temperatures. The apparatus includes a modular cryogenic cooler for removably interfacing with an insulated shipping container to maintain the interior of the container at a super-frozen temperature less than or equal to about −50 degrees C. Aspects of the method include a delivery method for providing an essentially unbroken delivery chain of frozen products from a location of freezing (to a super-frozen temperature) to a location of defrosting the products (e.g., a point of sale and/or consumption of the products).

43 Claims, 4 Drawing Sheets

U.S. PATENT DOCUMENTS

| | | | | | |
|---|---|---|---|---|---|
| 4,991,402 | A | | 2/1991 | Saia, III | |
| 5,125,237 | A | | 6/1992 | Saia, III et al. | |
| 5,320,167 | A | | 6/1994 | Johnson et al. | |
| 5,337,579 | A | | 8/1994 | Saia, III et al. | |
| 5,363,670 | A | | 11/1994 | Bartilucci | |
| 5,406,803 | A | | 4/1995 | Casto, II | |
| 5,450,977 | A | | 9/1995 | Moe | |
| 5,460,013 | A | | 10/1995 | Thomsen | |
| 5,555,733 | A | | 9/1996 | Claterbos et al. | |
| 5,564,277 | A | * | 10/1996 | Martin | 62/50.3 |
| 5,598,713 | A | | 2/1997 | Bartilucci | |
| 5,638,697 | A | | 6/1997 | Reznikov et al. | |
| 5,787,719 | A | | 8/1998 | Wilson | |
| 5,791,150 | A | | 8/1998 | Bosher et al. | |
| 5,819,550 | A | * | 10/1998 | Saia et al. | 62/239 |
| 5,953,928 | A | * | 9/1999 | Saia et al. | 62/239 |
| 6,003,322 | A | * | 12/1999 | Graham | 62/52.1 |

* cited by examiner

MODULAR APPARATUS AND METHOD FOR SHIPPING SUPER FROZEN MATERIALS

This application claims the benefit of Provisional Application No. 60/292,298 filed May 21, 2001.

BACKGROUND OF THE INVENTION (1) Field of the Invention

The present invention relates to a method and apparatus for shipping, storing and freezing super-frozen perishable materials. This invention more particularly relates to a modular cooler for removably interfacing with a shipping container and maintaining the interior of the container below −50° C.

(2) Background Information

Commercial fishing is a worldwide enterprise generating billions of dollars in revenue annually. With modem shipping and storage technology, fish caught nearly anywhere in the world may be efficiently frozen and subsequently transported to almost any market in the world for consumption thereof Particular products however, do not lend themselves to conventional freezing and shipping methods. In particular, fish intended for consumption in an uncooked or raw state such as sushi, generally may not be frozen using conventional equipment, without adversely affecting the quality (i.e., the color and/or taste) thereof. For this reason, fish intended for use as sushi tends to be caught locally so it may be brought to market relatively quickly without freezing. This necessity has tended to limit the supply of fish available for sushi and effectively increased the price thereof relative to frozen fish. There therefore tends to be a relatively large disparity between the price of sushi-grade fish and non-sushi grade (i.e., frozen) fish in the marketplace.

In a recent attempt to address this disparity, some commercial fishing enterprises have harvested fish, such as tuna and the like, in areas of the world where there is little local demand for sushi-grade product, and transported the product at cryogenic (i.e., super-cooled) temperatures of less than −40 degrees C. to the sushi markets. It has been found that at these temperatures tuna and the like maintain suitable freshness for sushi purposes to thus retain the relatively high quality and premium prices associated with sushi-grade product. This approach has generally required dedicated use of cargo ships known as super carrier vessels, outfitted with specialized refrigeration equipment specifically designed to maintain a constant cryogenic temperature of about −60 degrees C. The expense of such vessels typically dictates their use only when a substantially full shipment of approximately 100 metric tons (100,000 kilograms) or more of product is available for shipment. Accordingly, in order to satisfy this relatively high minimum volume requirement, such ships must generally remain at port or in the vicinity of tuna fishing fleets for extended periods of time as the fish are harvested and prepared for shipment. Disadvantageously, this aspect generally limits the number of trips from the fishing ports to the sushi markets to approximately one or two trips per year. For many perishable products this high volume requirement and low trip frequency renders this approach impractical. For many products that are in demand, the time required for shipment on a super carrier vessel, often several months from harvest to arrival at the destination, further makes such a shipping method undesirable.

Smaller shipments of conventionally frozen (i.e., 0 to −26 degrees C.) product have been shipped utilizing standard ISO containers on conventional transport ships. These ISO containers are relatively plentiful and the conventional transport ships travel on a relatively frequent basis to most desired destinations. These containers are typically refrigerated by use of mechanical refrigeration units associated with each individual ISO container. These refrigeration units, however, have not been capable of providing refrigerated temperatures of less than about −25 degrees C. Moreover, such mechanical units are prone to mechanical failure, in which about 5 to 10 percent of shipments are lost due to spoilage primarily due to mechanical breakdown and human error. Such units are also relatively expensive, generally costing on the order of $8000 to $10,000 for the container, an additional $10,000 to $12,000 for each refrigeration unit plus another $10,000 to $12,000 for an electric generator (i.e., genset) to provide electric power for the refrigeration unit. A further drawback of these mechanically refrigerated containers is that they typically must be transported on ships equipped for "reefer" (i.e., refrigerated) shipments, i.e., on ships capable of providing a continuous supply of fuel and/or electricity to the containers and including technicians capable of servicing the units in the event of a failure en-route. Shipping rates for such reefer containers tend to be considerably higher than rates for "dry" containers (i.e., those not requiring such services) of comparable size and weight.

Moreover, it has also been recognized that shipping rates for standard ISO shipping containers are significantly lower than for similarly sized and shaped containers, which are not ISO compliant. For example, a standard 40 foot ISO shipping container which may cost $2,000 (U.S.) to ship, may cost up to $15,000 if not ISO compliant. This discrepancy is due largely to the ability to stack shipping containers, which have been certified to comply with ISO standards with respect to size, shape, structural integrity, and/or ability to interlock to one another.

Graham, in U.S. Pat. No. 6,003,322, which is fully incorporated herein by reference and hereafter referred to as the '322 patent, discloses an apparatus and method for shipping product disposed at a super-frozen temperature of less than or equal to about −50 degrees C. The apparatus desirably includes an ISO certified container having walls insulated to an r-value greater than or equal to about 20 and a spray head disposed within the container to spray cryogenic fluid. The container is further selectively sealable to form a self-contained, dry module capable of receiving product at the super-frozen temperature and maintaining the product at super-frozen temperature during shipment thereof.

Notwithstanding the substantial improvements disclosed in the Graham patent, there remains a need for an improved apparatus and method for shipping product disposed at super-frozen temperatures, and in particular there exists a need for those providing for increased versatility in shipping product at super-frozen temperatures.

SUMMARY OF THE INVENTION

In one aspect, the present invention includes a modular cryogenic cooler for removably interfacing with an insulated container, the container being configured for maintaining an interior of the container at a super-frozen temperature of less than or equal to about −50 degrees C. The cryogenic cooler includes a modular connector configured for removable engagement with the container, a cryogenic fluid transport module coupled to the modular connector, the transport module having a cryogenic fluid supply coupling. The supply coupling is couplable to a cryogenic fluid source, and the transport module is configured to selectively feed cryogenic fluid from the source to the container. A controller is operationally coupled to the transport module.

In another aspect, this invention includes a portable apparatus configured for freezing and storing fish at a super-frozen temperature of less than or equal to about −50 degrees C., to preserve the fish at sushi-quality. The apparatus includes a container having an interior and a modular cryogenic cooler removably engaged with the container. The modular cryogenic cooler includes a modular connector sized and shaped for removable engagement with said container;

a cryogenic fluid transport module coupled to said modular connector, and having a cryogenic fluid supply coupling, and a controller operationally coupled to the transport module. The supply coupling is couplable to a cryogenic fluid source, and the transport module is configured to selectively feed cryogenic fluid from the cryogenic fluid source to the container.

In yet another aspect, this invention includes a method for storing product disposed at a super-frozen temperature of less than or equal to about −50 degrees C. The method includes providing product disposed at the super-frozen temperature, providing an insulated shipping container having an interior, and providing a modular cryogenic cooler configured for maintaining the interior of the container at the super-frozen temperature. The cryogenic cooler includes a modular connector configured for removable engagement with the shipping container, a cryogenic fluid transport module coupled to the modular connector, the transport module having a cryogenic fluid supply coupling and a controller operationally coupled to the transport module. The method further includes placing the product into the interior of the insulated shipping container, coupling the modular connector to the insulated shipping container, coupling the supply coupling to a crygogenic fluid source; and selectively actuating the transport module to feed cryogenic fluid from the source to the interior of the shipping container to maintain the interior at the super-frozen temperature.

In still another aspect, this invention includes a method for providing sushi-quality fish harvested at a first location, to a distinct second location. The method includes freezing harvested fish at the first location to a super-frozen temperature of less than or equal to about −50 degrees C., loading the fish, disposed at the super-frozen temperature, into an insulated shipping container, the shipping container including walls insulated to an r-value greater than or equal to about 20, charging the shipping container with a first cryogenic fluid, wherein the first cryogenic fluid is disposed into the container and onto the product, sealing the shipping container to form a self-contained, dry module, and transporting the shipping container to the second location. The method further includes providing a modular cryogenic cooler configured for maintaining the interior of the modular shipping container at the super-frozen temperature, the cooler including a fan, an air intake coupled to the fan, a cryogenic fluid transport module having a cryogenic fluid supply coupling and a cryogenic fluid dispensing coupling, and a controller operationally coupled to the transport module, coupling the cryogenic cooler with the modular shipping container, coupling the supply coupling to a source of a second cryogenic fluid, and selectively feeding the second cryogenic fluid from the source to the interior of the shipping container to maintain the interior at the super-frozen temperature.

In a further aspect, this invention includes a method for providing an essentially unbroken delivery chain of super-frozen products at super-frozen temperatures of less than or equal to about −50 degrees C. from a point of freezing to a point of de-frosting. The method includes providing product disposed at the super-frozen temperature at a first location, loading the product into a first insulated container, and shipping the first container from the first location to a second location. The method further includes coupling a cryogenic cooler configured for maintaining the interior of the container at the super-frozen temperature to the first container, the cooler including a fan, an air intake coupled to the fan, a cryogenic fluid transport module having a cryogenic fluid supply coupling and a cryogenic fluid dispensing coupling, and a controller operationally coupled to the transport module, transferring at least a portion of the super-frozen product from the first container to a second insulated container, and shipping the second container from the second location to a third location.

DETAILED DESCRIPTION

Figure 1:
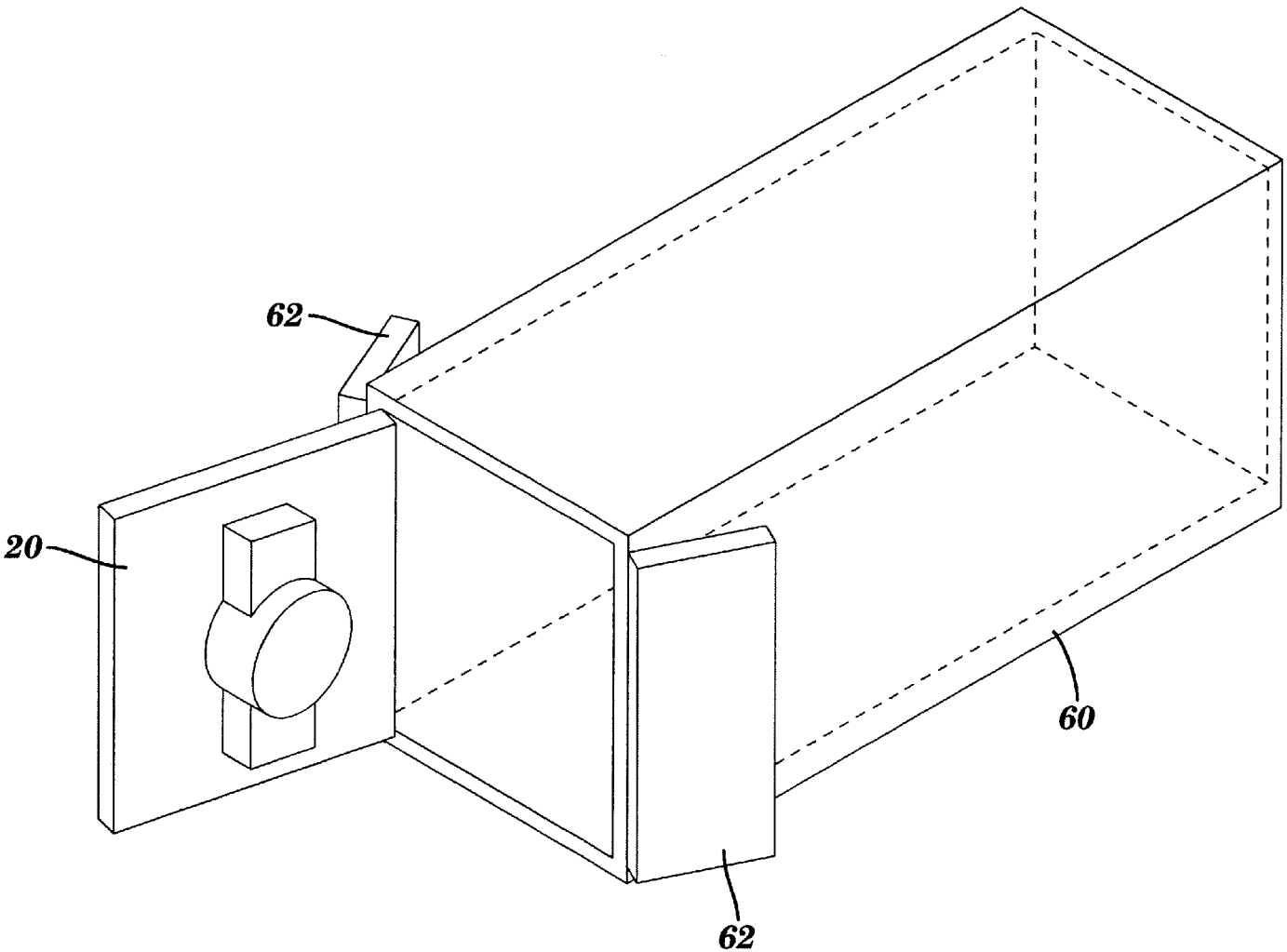
FIG. 1 is schematic representation of an apparatus according to the principles of the present invention.

Referring briefly to FIG. 1, an apparatus constructed according to the principles of the present invention is shown. Briefly described, the present invention includes a modular, cryogenic cooler 20, which utilizes cryogenic fluids, for removably interfacing with an insulated container 60 for maintaining the interior of the container at a super-frozen temperature less than or equal to about −50 degrees C. Upon arrival at a facility, a container (e.g., container 60) including product transported at super-frozen temperatures may be connected to cooler 20, which maintains the product at super-frozen temperatures. The present invention also includes a delivery method (i.e., a super-frozen pipeline) for providing an essentially unbroken delivery chain of frozen products from the point of freezing (i.e., to a super-frozen temperature) to the point of defrosting the products (i.e., at a point of sale and/or consumption of the products).

This invention is advantageous in that it provides a modular cooler 20 for maintaining the contents of a container at a super-frozen temperature (i.e., less than about −50 degrees C.). The cooler may be interfaced with standard containers of many sizes, shapes and configurations, and in particular with ISO certified shipping containers. The delivery method is further advantageous in that it provides a relatively cost effective and space efficient method of providing an essentially continuous stream of super-frozen product to an end user. The delivery method further allows for the transport of a relatively wide range of quantities of product, from those that are relatively large (for example, greater than 20 metric tones, i.e., 20,000 kilograms) to those that are relatively small (such as about 100 kilograms or less). This invention is still further advantageous in that it provides for the delivery of an effectively continuous stream of sushi-grade product to an end user.

Referring again to FIG. 1, one embodiment of the cryogenic cooler 20 of this invention is shown connected to container 60. In a generally desirable embodiment, cooler 20 includes a modular connector in the form of a door that is sized and shaped for being coupled to container 60 by opening one of the doors 62 on the container 60 and placing the cooler in the door opening (e.g., in the doorway). For example, cooler 20 may be sized and shaped as a replacement door, including fixtures (shown and discussed in more detail hereinbelow with respect to FIGS. 3A and 3B) for hinging and sealing it in place. Container 60 may include essentially any container suitable for shipping super-frozen product. For example, in one embodiment, the container walls 64 are insulated to an r-value of greater than or equal to about 20 (more detail regarding container insulation may be found in the '322 patent). Cryogenic cooler 20 maybe configured for use with substantially any commercial and/or custom shipping and/or storage container, such as, but not limited to standard ISO, or non-standard containers. It is generally desirable that container 60 is configured according to standard ISO shipping container dimensions and guidelines. For example, container 60 may be an ISO certified freight container such as are typically used in ocean going vessels and rail freight. Alternatively, container 60 may be an ISO certified air mode modular container, such as the LD3, LD5, or LD9 containers that are typically used for air-freight.

Figure 2:
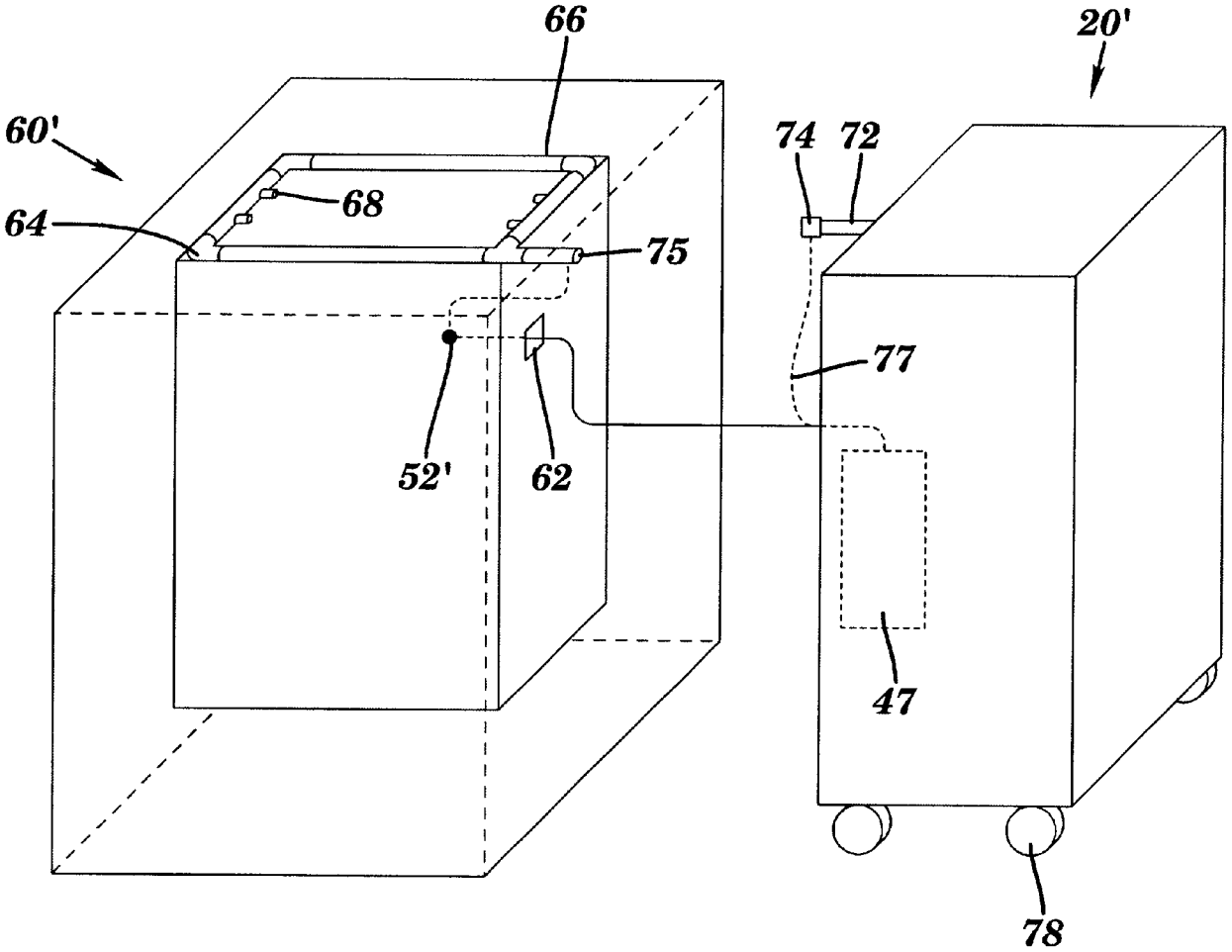
FIG. 2 is a schematic representation of one embodiment of a container configured for use with the cooler of the present invention.

Referring now to FIG. 2, an example of an LD3 container 60' configured for use with a cryogenic cooler constructed according to the principles of this invention is shown. Container 60' is configured for use with a stand-alone embodiment of cryogenic cooler 20'. Stand-alone cooler 20' typically includes a modular connector in the form of a quick release coupling 74 disposed at a terminal end of conduit 72. Coupling 74 is sized and shaped for removable engagement with a mating coupling 75 of container 60' for distributing cryogenic fluid to the interior thereof. The modular connector may also include an electrical portion configured to sense temperature and/or oxygen. For example, the electrical portion of the modular connector may include one or more probes 52' configured for extension through a port 62 of the container. Alternatively, container 60' may include an integral probe (e.g., for temperature, oxygen sensing, and/or sensing other conditions) connected (e.g., electrically) to coupling 75. In such an event, the electrical portion of the modular connector of cooler 20' may include an electrical probe lead 77 connected to coupling 74 as shown in phantom. In such a configuration, mutual engagement of couplings 74 and 75 serves to connect conduit 72 to conduit 64, while simultaneously interconnecting one or more probes 52' to lead(s) 77. The skilled artisan will recognize that the electrical portion of the modular coupling may be disposed integrally with coupling 74 (as shown in phantom), or may be disposed discretely from coupling 74, without departing from the spirit and scope of the present invention.

Cooler 20' is typically mounted on wheels 78 for easy transport and maneuverability thereof. Container 60' includes piping 64 for distributing cryogenic fluids (supplied by cryogenic cooler 20' through conduit 72) into the interior thereof. Container 60' further includes a cryogenic fluid supply coupling 66 and a plurality of cryogenic fluid dispensing couplings 68. The artisan of ordinary skill will readily recognize that any container type or size may be configured in a manner similar to that shown in FIG. 2.

Figure 3A:
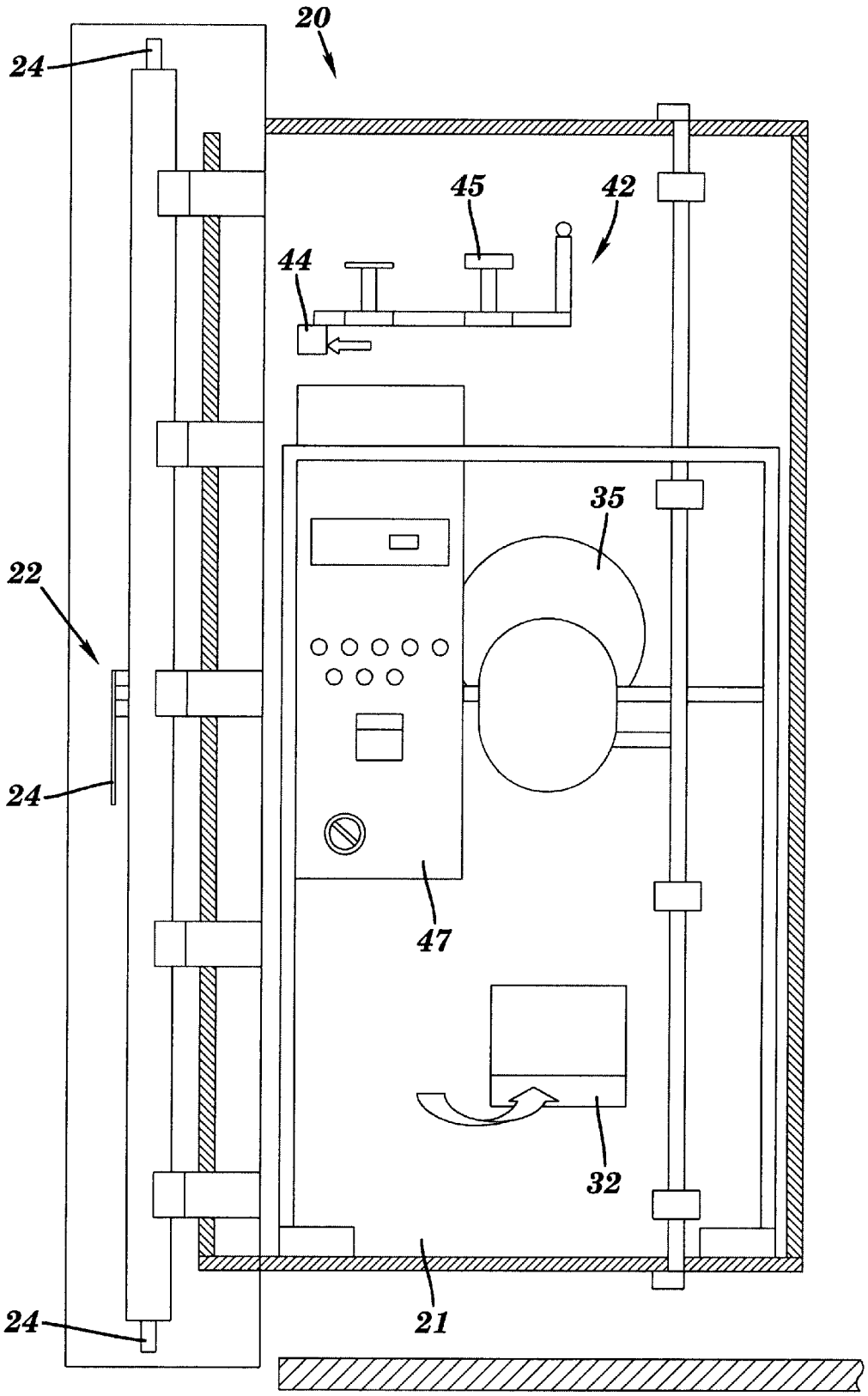
FIG. 3A is a front view schematic representation of one embodiment of the cooler of this present invention.
Figure 3B:
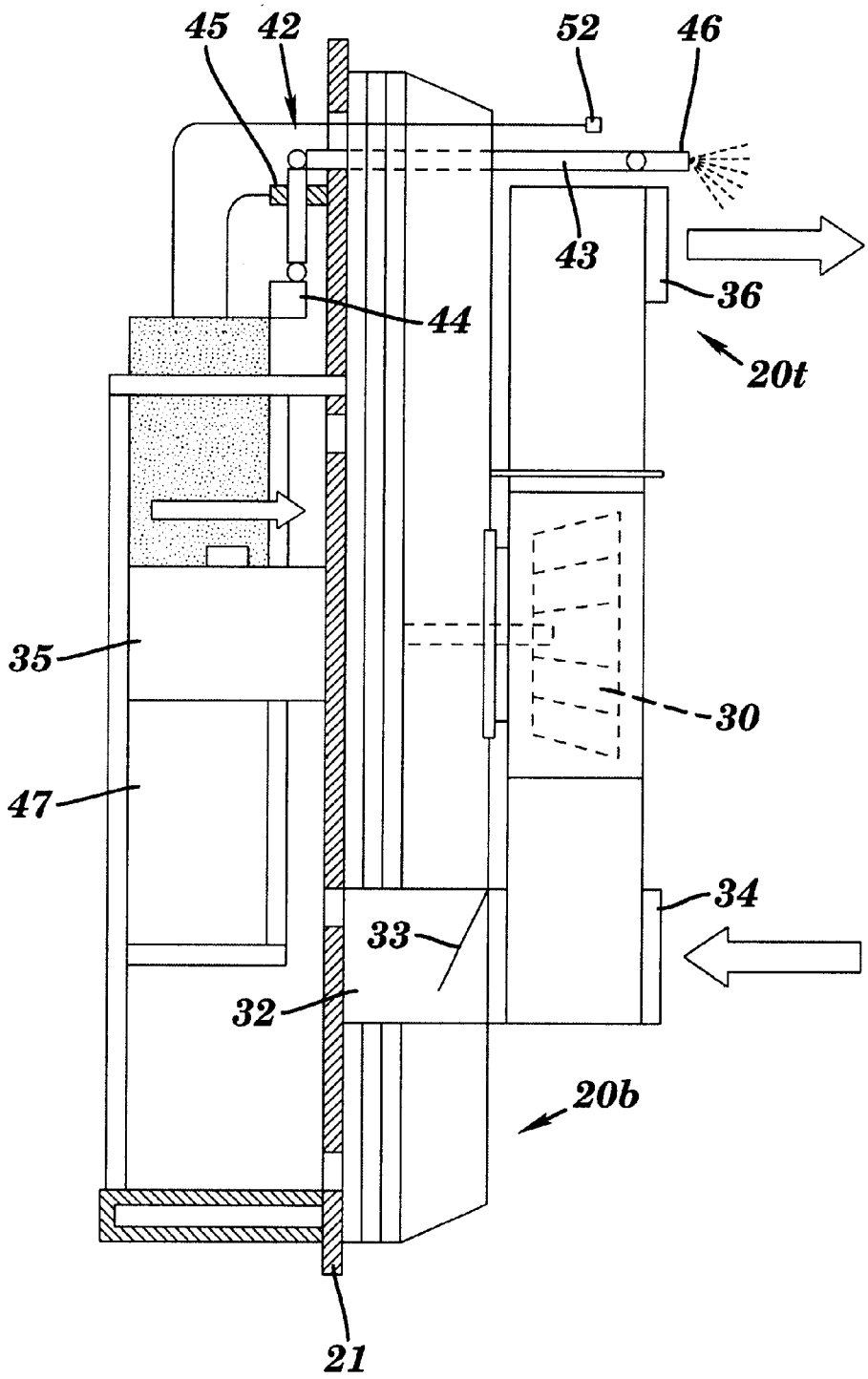
FIG. 3B is a side view schematic representation of the cooler shown in FIG. 3A.

Referring now to FIGS. 3A and 3B, one embodiment of the cryogenic cooler 20 of this invention is shown. Cryogenic cooler 20 includes a modular connector configured in the form of an insulated (replacement) door 21 (also referred to as a false end), which provides for relatively simple interfacing with many standard ISO certified containers. For example, the modular connector of cooler 20 may include a door portion including one or more hinges 22 having pins 24 for providing a relatively simple and well-sealed interface to a doorway of the container. Cryogenic cooler 20 may further include a fan 30 for providing circulation within container 60 (FIG. 1). Fan 30 is typically coupled to a fresh air intake 32 for providing a controlled flow of fresh air into container 60. Air intake 32 typically includes a flapper valve 33 configured to function as a one-way check valve. Intake 32 may also function as a pressure release valve, enabling release of excess pressure generated by evaporation (and/or sublimation) of the cryogenic fluids (or solids such as $CO_2$ snow) in container 60. Fan 30 may also be coupled to ducting 35, which includes an intake 34 and an exhaust 36, for promoting more efficient circulation within the container 60. In one embodiment, intake 34 is positioned towards the bottom **20*b* (i.e., lower) end of cooler 20 and exhaust 36 is positioned towards the top 20*t* (i.e., upper) end of cooler 20. This configuration helps maintain a relatively even super-frozen temperature distribution in the interior of the container 60 by drawing relatively cool air that settles to the bottom portion of the interior of container 60 and distributing it near the top thereof. Fan 30 is further typically coupled to an electric motor 38**.

Cooler 20 further includes a cryogenic fluid transport module 42 (e.g., a manifold) for transporting cryogenic fluids to the interior of the container 60. Manifold 42 includes a cryogenic fluid supply coupling 44 and a cryogenic fluid dispensing coupling 43. Cryogenic fluid supply coupling 44 may be any coupling known to those skilled in the art, such as a conventional quick release coupling. Cryogenic fluid dispensing coupling 43 may also be any coupling known to those skilled in the art, but typically includes a spray head 46 to provide for adequate distribution of cryogenic fluid within the container 60. Alternatively, dispensing coupling 43 is configured for connection to piping which terminates at one or more spray heads (such as piping 64 and spray heads 68 shown in FIG. 2) in container 60 for distributing cryogenic fluid therein, as described in greater detail hereinbelow. Module 42 further includes a metering valve 45 for selectively feeding cryogenic fluid to the interior of the container 60. Module 42 may generally utilize substantially any cryogenic fluid, such as liquid nitrogen, liquid oxygen, liquid carbon dioxide, combinations thereof, and the like, with liquid nitrogen being generally desirable.

Cryogenic cooler 20 further includes a thermostatic controller 47 that is operationally coupled to module 42. Controller 47 functions to maintain the super-frozen temperatures in the interior of the container by selectively opening and closing metering valve 45. Controller 47 may include a programmable processor (not shown), such as a microprocessor or a microcontroller, and may also include computer readable program code including instructions for controlling the function of the metering valve 45. Controller 47 also includes a probe 52 appropriately sized, shaped, positioned, and configured for providing relatively accurate and representative measurement of parameters such as the super-frozen temperatures (i.e., less than or equal to about −50 degrees C.) in the container 60. Controller 47 may optionally include other sensors and/or probes 52 for monitoring other physical parameters within the container (e.g., an oxygen probe for measuring oxygen concentration). The cryogenic cooler of this invention is useful for maintaining the contents of a container (e.g., container 60, 60') at a super-frozen temperature (i.e., less than about −50 degrees C.). For example, in operation, a product disposed at a super-frozen temperature may be loaded into a container 60. Cryogenic cooler 20 is coupled to the container 60 as well as to a source of cryogenic fluid, either prior to or after the loading of the contents described above. The cryogenic cooler 20 then monitors the temperature in the interior of the container 60 and selectively feeds cryogenic fluid therein to maintain the contents thereof at a super-frozen temperature.

Cooler 20 may alternatively be useful for super-freezing (i.e., freezing to a super-frozen temperature) the contents of a container. For example, instead of loading the container 60 with contents disposed at a super-frozen temperature, the container 60 maybe loaded with contents having a temperature greater than about −50 degrees C. (e.g., raw fish and/or fish frozen by conventional means). To facilitate such freezing, it may be desirable to permanently or removably dispose one or more fans in the interior of the container to circulate the cryogenic fluid. These fans may be especially beneficial when using relatively large containers and/or contents predisposed at ambient temperatures, such as, for example, a 40 foot container initially filled with raw fish).

The cryogenic cooler 20 of this invention is particularly useful for shipping products, which are disposed at a super-frozen temperature. For example, a product disposed at a super-frozen temperature may be shipped in a sealed container, as described in the '322 patent. Upon arrival at a facility, such as a distribution center or a warehouse, the container may be connected to a cryogenic cooler 20, which may maintain the interior thereof at a super-frozen temperature for an extended period of time (essentially indefinitely). This is advantageous in that it enables the product to be stored at a super-frozen temperature for as long as necessary. Alternatively, the cryogenic cooler 20 of this invention may be coupled to a container including product disposed at a super-frozen temperature and the combination shipped together to another location. In one embodiment, the cryogenic cooler of this invention may be used to provide sushi-quality fish from a first location (such as a point of harvest) to distinct second location. Typically, the fish is frozen to a super-frozen temperature soon after harvest (e.g., within a few hours). The fish may be frozen and/or stored at the first location using cryogenic cooler 20 as described above. Alternatively, a separate freezer, adapted for freezing product to super-frozen temperatures, may be utilized. The super-frozen fish are typically loaded into a container 60, 60', which is charged with cryogenic fluid, sealed to form a self-contained dry module, and shipped to the second location as described in the '322 patent. Upon arrival at the second location, the container may be connected to a cryogenic cooler 20 as described above. The fish may then be stored indefinitely at a super-frozen temperature at the second location. Thereafter, the container may be unloaded incrementally, e.g., into smaller containers 60' for further shipment and/or storage, for ultimate use by the end-user of the sushi-quality fish. In this manner, the present invention provides for a "super-frozen pipeline" or "cold chain" as discussed in greater detail hereinbelow. This method of providing sushi-quality fish is advantageous in that it tends to preserve the fish at a very high quality. Moreover, since the fish may be frozen at a super-frozen temperature for all but a few hours between harvest and consumption, this method also tends to reduce bacteria count in the fish relative to conventional non-frozen sushi-quality fish. The above method significantly exceeds the recommendations of the U.S. Food and Drug Administration (Rockville, Md.) "Fish and Fishery Products Hazards and Controls Guidance".

As mentioned above, the cryogenic cooler 20 of this invention is useful for providing a "super-frozen pipeline" (i.e., an essentially unbroken delivery chain of super-frozen product) from a point of freezing to a point of delivery. The apparatus is particularly useful in providing an essentially continuous delivery chain of sushi-grade product from a point of harvest (e.g., and ocean going fishing vessel or fleet) to an end user (e.g., a distributor, wholesaler, retailer, or even a sushi restaurant).

For example, a forty-foot shipping container 60, similar to that described in the '322 patent, may be loaded with approximately 20 metric tons or more of super-frozen product (e.g., tuna loins) at a first location and shipped to a second location. Upon arrival at the second location (e.g., a distributor, wholesaler, or centralized warehousing facility), a cryogenic cooler (e.g., cooler 20) is interfaced to the shipping container providing for automatic regulation of the super-frozen temperatures in the interior thereof. The super-frozen product may be stored for an indefinite time at the second location prior to being shipped to one or more third locations. The product may be shipped to the third locations in the same forty-foot container or in one or more smaller containers, such as but not limited to ISO LD3 containers 60'. At the one or more third locations a cryogenic cooler 20' may be interfaced to the shipping container to provide for automatic regulation of the super-frozen temperature in the interior thereof. This process may be repeated until the product is ultimately defrosted and/or consumed, e.g., at a supermarket, hotel, or restaurant.

Advantageously, providing storage capability at the second location (e.g., in container 60 at a distributor site) enables the use and delivery of bulk liquid carbon dioxide. This may enable a distributor to produce dry ice (i.e., solid carbon dioxide) from the bulk liquid. The process of delivering super frozen product to one or more third locations consumes a significant volume of dry ice. Provision of liquid carbon dioxide at the distributor site for storage in a container (e.g., container 60) provides for the on-demand production of dry ice at a relatively low cost and substantially eliminates the need for a distributor to maintain regular deliveries and/or dry ice inventories at relatively higher cost.

The following example illustrates one embodiment of the cryogenic cooler of this invention. The scope of this invention is not to be considered as limited by the specific embodiment described therein, but rather as defined by the claims.

EXAMPLE 1

A cryogenic cooler, according to the principles of the present invention, was fabricated. The cryogenic cooler of this example was constructed substantially as shown in FIGS. 3A and 3B above and was sized, shaped, and otherwise configured for use with a forty-foot, ISO certified container. The container of this example was fabricated as follows:

| | |
|---|---|
| (21) False-end: | Width: 1350 mm (Equipment 1200 mm & Door 150 mm)<br>Length: 2220 mm (Door)<br>Height: 2670 mm (Wheels 230 mm & Door 2440 mm) |
| (22,24) Hinges/pins: | Hot dip galvanized pressed steel plate (JIS SS400)<br>Each door was suspended by five (5) hinges with nylon bushes and stainless steel washers places at the hinge lug of the rear corner post of the container<br>Hinge lug: 6.0 mm (15/64") thick M.G.S.S. plate.<br>Hinge pin: 12.4 mm (½") diameter bar, stainless steel. |
| (30) Electric fan: | Model N46 CW 90 centrifugal fan with galvanized body |
| (35) Electric motor: | 2.2 kW 4 pole direct coupled drive motor |
| (42) LN2 manifold: | 20NB cryogenic ball valve, Model 07-C4-11PMSE fitted with a pneumatic spring return (fail closed) actuator Model 10-RDB40-1SDBEO-D |
| (46) Spray nozzle: | 20NB cryogenic Y-type strainer |
| (45) Metering valve: | 20NB globe valve, cryogenic type |
| (47) Controller: | Model SR70 Series Digital Controller (Shimaden Co., Ltd., Tokyo, Japan) self-contained control panel with temperature control and interlocks |
| Temperature probe: | Built into the controller by IWI Cryoquip |
| Oxygen probe: | Model WM-5 oxygen monitor, 0–25% with dual adjustable setpoint alarms and push to view setpoint buttons |

The cryogenic cooler of this example was coupled to a forty foot ISO certified container, which was filled with fish disposed at a super-frozen temperature. The cryogenic fluid supply coupling was coupled to a liquid nitrogen tank. The cryogenic cooler successfully maintained the temperature of the interior of the container at or below negative 50 degrees C. Super frozen fish was periodically removed from the container, defrosted, and tested for quality. The fish was found to be of a high quality, suitable for consumption as sushi. Further, 300 pounds of super frozen fish and dry ice was loaded from the above-mentioned container into an LD3 container and shipped by air to Chicago, U.S.A, where it was defrosted and found to be suitable for consumption as sushi.

The skilled artisan should recognize that although specific exemplary embodiments have been shown and described herein, which dispense cryogenic gas to attain desired super-frozen temperatures, the skilled artisan will recognize that conventional mechanical systems that typically employ a compressor, condenser, and a coolant circulating within a closed system, may be employed, in which the term 'cryogenic gas' will refer to cooled air or other fluid being generated by such mechanical system, without departing from the spirit and scope of the present invention.

The modifications to the various aspects of the present invention described hereinabove are merely exemplary. It is understood that other modifications to the illustrative embodiments will readily occur to persons with ordinary skill in the art. All such modifications and variations are deemed to be within the scope and spirit of the present invention as defined by the accompanying claims.

What is claimed is:

1. A modular cryogenic cooler for removably interfacing with an insulated container, said cooler being configured for maintaining an interior of the container at a super-frozen temperature of less than or equal to about −45 degrees C., said cryogenic cooler comprising:

a modular connector configured for removable engagement with the container;

a cryogenic fluid transport module coupled to said modular connector;

said transport module having a cryogenic fluid supply coupling;

said supply coupling being couplable to a cryogenic fluid source;

said transport module being configured to selectively feed cryogenic fluid from the source to the container;

a controller operationally coupled to said transport module to maintain the interior of the container at the super-frozen temperature;

said controller including a programmable processor having computer readable program code embodied therein, the computer readable program code including instructions for:

receiving a temperature reading from a temperature probe;

comparing said temperature reading to a preselected temperature;

actuating said transport module to selectively feed cryogenic fluid from said source to said container; and wherein said modulator connector comprises a door sized and shaped for sealing engagement with an opening of the container.

2. The cryogenic cooler of claim 1, further comprising:

a fan coupled to said transport module, said fan being to effect circulation of said cryogenic fluid within the container.

3. The cryogenic cooler of claim 1, further comprising at least one temperature probe communicably coupled to said controller, said at least one temperature probe being sized, shaped, and positioned to monitor the temperature of the interior of the container.

4. The cryogenic cooler of claim 1, wherein said transport module comprises a metering valve.

5. The cryogenic cooler of claim 1 wherein said cryogenic fluid dispensing coupling comprises at least one spray nozzle.

6. The cryogenic cooler of claim 1, wherein said modular connector comprises a cryogenic fluid dispensing coupling; and said dispensing coupling is matingly couplable to a cryogenic fluid inlet of the container to dispense cryogenic fluid being fed from the transport module.

7. The cryogenic cooler of claim 6 wherein said cryogenic fluid dispensing coupling comprises a quick release coupling.

8. The cryogenic cooler of claim 1 wherein said cryogenic fluid comprises liquid nitrogen.

9. The cryogenic cooler of claim 1 wherein said cryogenic cooler is configured as a personnel door for selectively providing entrance to and exit from the interior of the container.

10. The cryogenic cooler of claim 2 further comprising ducting coupled to said fan for channeling said circulation.

11. The cryogenic cooler of claim 10, wherein said ducting comprises an air intake.

12. The cryogenic cooler of claim 10 wherein said ducting and said fan are suitably sized and shaped, and suitably positioned on said cryogenic cooler for disposition in the interior of the container when said modular connector is engaged with the container.

13. A modular cryogenic cooler for removably interfacing with an insulated container, said cooler being configured for maintaining an interior of the container at a super-frozen temperature of less than or equal to −45 degrees C., said cryogenic cooler comprising:

a configuration in the form of an insulated door;

a modular connector configured for removable engagement with the container;

a cryogenic fluid transport module coupled to said modular connector;

said transport module having a cryogenic fluid supply coupling;

said supply coupling being couplable to a cryogenic fluid source;

said transport module being configured to selectively feed cryogenic fluid from the source to the container;

a controller operationally coupled to said transport module to maintain the interior of the container at the super-frozen temperature;

said controller including a programmable processor having computer readable program code embodied therein, the computer readable program code including instructions for:

receiving a temperature reading from a temperature probe;

comparing said temperature reading to a preselected temperature; and actuating said transport module to selectively feed cryogenic fluid from said source to said container;

at least one temperature probe communicably coupled to said controller, said at least one temperature probe being sized, shaped, and positioned to monitor the temperature of interior of the container;

ducting coupled to a fan circulating atmosphere within the interior of the container; and said transport module including a metering valve.

14. A portable apparatus configured for freezing and storing fish at a super-frozen temperature of less than or equal to about −45 degrees C., to preserve the fish at sushi-quality, the apparatus comprising:

a container;

a modular cryogenic cooler removably engaged with said container, said modular cryogenic cooler including:

a modular connector sized and shaped for removable engagement with said container;

a cryogenic fluid transport module coupled to said modular connector;

said transport module having a cryogenic fluid supply coupling;

said supply coupling being couplable to a cryogenic fluid source;

said transport module being configured to selectively feed cryogenic fluid from the source to the container;

a controller operationally coupled to said transport module;

the controller including a programmable processor having computer readable program code embodied therein, the computer readable program code including instructions for:

receiving a temperature reading from a temperature probe;

comparing said temperature reading to a preselected temperature; and actuating said transport module to selectively feed cryogenic fluid from said source to said container; and said container including:

a port configured for interfacing with a probe, the port including an other modular connector sized and shaped for removable engagement with said modular connector; and at least one probe including an oxygen sensor, being sized, shaped, and positioned to monitor the interior of the container, said at least one probe being coupled to said other connector for coupling said probe to said modular cryogenic cooler.

15. The portable apparatus of claim 14, further comprising a fan and an air intake coupled to said fan.

16. The apparatus of claim 14, wherein said port is configured for receiving a probe therein.

17. The apparatus of claim 14, wherein said modular connector comprises a cryogenic fluid dispensing coupling and said other modular connector includes a cryogenic fluid inlet coupling.

18. The apparatus of claim 14, wherein said at least one probe comprises a temperature probe.

19. The apparatus of claim 14 wherein at least one of said container and said cryogenic cooler is adapted for being shipped to a destination for deployment at the destination to freeze and store fish at the super-frozen temperature, and for being subsequently re-shipped to an other destination for re-deployment.

20. The apparatus of claim 14, wherein said container is sized and shaped to standard ISO container dimensions.

21. The apparatus of claim 14, wherein said container is selected from the group consisting of a 20 foot container, a 40 foot container, an LD3 container, an LD5 container, and an LD9 container.

22. A portable apparatus configured for freezing and storing fish at a super-frozen temperature of less than or equal to −45 degrees C., to preserve the fish at sushi-quality, the apparatus comprising:

a container insulated to an r-value of greater than or equal to 20;

a modular cryogenic cooler removably engaged with said container, said modular cryogenic cooler including:

a modular connector sized and shaped for removable engagement with said container;

a cryogenic fluid transport module coupled to said modular connector;

said transport module having a cryogenic fluid supply coupling;

said supply coupling being couplable to a cryogenic fluid source;

said transport module being configured to selectively feed cryogenic fluid from the source of the container;

a controller operationally coupled to said transport module;

the controller including a programmable processor having computer readable program code embodied therein, the computer readable program code including instructions for:

receiving a temperature reading from a temperature probe;

comparing said temperature reading to a preselected temperature; and actuating said transport module to selectively feed cryogenic fluid from said source to said container.

23. A portable apparatus configured for freezing and storing fish at a super-frozen temperature of less than or equal to −45 degrees C., to preserve the fish at sushi-quality, the apparatus comprising:

a container including poly-foam insulation, a $CO_2$ spray-head, a liquid $CO_2$ dispersal system and door seals wherein materials or products contained therein are maintainable at or below the super-frozen temperature;

a modular cryogenic cooler removably engaged with said container, said modular cryogenic cooler including:

a modular connector sized and shaped for removable engagement with said container;

a cryogenic fluid transport module coupled to said modular connector;

said transport module having a cryogenic fluid supply coupling;

said supply coupling being couplable to a cryogenic fluid source;

said transport module being configured to selectively feed cryogenic fluid from the source to the container;

a controller operationally coupled to said transport module;

the controller including a programmable processor having computer readable program code embodied therein, the computer readable program code including instructions for:

receiving a temperature reading from a temperature probe;

comparing said temperature reading to a preselected temperature; and actuating said transport module to selectively feed cryogenic fluid from said source to said container.

24. A portable apparatus configured for freezing and storing fish at a super-frozen temperature of less than or equal to −45 degrees C., to preserve fish at sushi-quality, the apparatus comprising:

a container including a first section adapted for freezing the fish and a second section adapted for storing the fish at the super-frozen temperature;

a modular cryogenic cooler removably engaged with said container, said modular cryogenic cooler including:

a modular connector sized and shaped for removable engagement with said container;

a cryogenic fluid transport module coupled to said modular connector;

said transport module having a cryogenic fluid supply coupling;

said supply coupling being couplable to a cryogenic fluid source;

said transport module being configured to selectively feed cryogenic fluid from the source to the container;

a controller operationally coupled to said transport module;

the controller including a programmable processor having computer readable program code embodied therein, the computer readable program including instructions for:

receiving a temperature reading from a temperature probe;

comparing said temperature reading to a preselected temperature; and actuating said transport module to selectively feed cryogenic fluid from said source to said container.

25. The apparatus of claim 14, wherein said cryogenic fluid source comprises liquid nitrogen.

26. A method for storing product disposed at a super-frozen temperature of less than or equal to about −45 degrees C., said method comprising:

coupling a modular connector of a cryogenic cooler to an insulated shipping container including therein product disposed at the super-frozen temperature, the cryogenic cooler being configured for maintaining the interior of the container at the super-frozen temperature, the cooler including:

a modular connector configured for removable engagement with the shipping container;

a cryogenic fluid transport module coupled to the modular connector;

the transport module having a cryogenic fluid supply coupling; and a controller operationally coupled to said transport module;

the controller including a programmable processor having computer readable program code embodied therein, the computer readable program code including instructions for:

receiving a temperature reading from a temperature probe;

comparing said temperature reading to a preselected temperature; and actuating said transport module to selectively feed cryogenic fluid from said source to said container;

coupling the supply coupling to a crygogenic fluid source; and selectively actuating the transport module to feed cryogenic fluid from the source to the interior of the shipping container to maintain the interior at the super-frozen temperature, wherein said coupling the modular connector to the insulated shipping container comprises opening a door on said container, hinging the cryogenic cooler in place of the door to form a replacement door, and closing the replacement door.

27. The method of claim 26 further comprising measuring the temperature of the interior of the container.

28. The method of claim 26 wherein the product is frozen fish.

29. The method of claim 26 wherein the product is frozen fish and said storing preserves the fish at sushi quality.

30. A method for storing product disposed at a super-frozen temperature of less than or equal to −45 degrees C., said method comprising:

coupling a modular connector of a cryogenic cooler to an insulate shipping container including therein product disposed at the super-frozen temperature, the cryogenic cooler being configures for maintaining the interior of the container at the super-frozen temperature, the cooler including:

a modular connector configured for removable engagement with the shipping container;

a cryogenic fluid transport module coupled to the modular connector;

the transport module having a cryogenic fluid supply coupling; and a controller operationally coupled to said transport module;

the controller including a programmable processor having computer readable program code embodied therein, the computer readable program code including instructions for:

receiving a temperature reading from a temperature probe;

comparing said temperature reading to a preselected temperature; and actuating said transport module to selectively feed cryogenic fluid from said source to said container;

coupling the supply coupling to a cryogenic fluid source; and selectively actuating the transport module to feed cryogenic fluid from the source to the interior of the shipping container to maintain the interior at the super-frozen temperature;

wherein:

the container comprises an other modular connector sized and shaped for removable engagement with the modular connector, the other modular connector including a cryogenic fluid inlet coupling for dispensing cryogenic fluid fed from the transport module; and said coupling the modular connector to the shipping container includes engaging the dispensing coupling with the cryogenic fluid inlet coupling.

31. A method for storing product disposed at a super-frozen temperature of less than or equal to −45 degrees C., said method comprising:

coupling a modular connector of a cryogenic cooler to an insulated shipping container insulated to an r-value of greater than or equal to 20, the container including therein product disposed at the super-frozen temperature, the cryogenic cooler being configured for maintaining the interior of the container at the super-frozen temperature, the cooler including:

a modular connector configured for removable engagement with the shipping container;

a cryogenic fluid transport module coupled to the modular connector;

the transport module having a cryogenic fluid supply coupling; and a controller operationally coupled to said transport module;

the controller including a programmable processor having computer readable program code embodied therein, the computer readable program code including instructions for:

receiving a temperature reading for a temperature probe;

comparing said temperature reading to a preselected temperature; and actuating said transport module to selectively feed cryogenic fluid from said source to said container;

coupling the supply coupling to a cryogenic fluid source; and selectively actuating the transport module to feed cryogenic fluid from the source to the interior of the shipping container to maintain the interior at the super-frozen temperature.

32. The method of claim 26 wherein said cryogenic fluid comprises liquid nitrogen.

33. The method of claim 26 wherein said insulated shipping container, including said product disposed therein and said cryogenic cooler coupled thereto, is transported to another location.

34. A method for shipping and storing fish at a super-frozen temperature of less than or equal to −45 degrees C., to preserve the fish at sushi-quality, the method comprising:

using a modular shipping container configured to maintain the product at the super-frozen temperature, the modular shipping container including walls insulated to an r-value greater than or equal to 20;

placing the product into the modular shipping container;

charging the modular shipping container with a cryogenic fluid, wherein said cryogenic fluid is disposed into the modular shipping container and onto the product;

sealing the modular shipping container to form a self-contained, dry module;

transporting the modular shipping container to a destination wherein the product is provided at the super-frozen temperature;

using a modular cryogenic cooler configured for maintaining the interior of the modular shipping container at the super-frozen temperature, the cooler including:

a fan;

an air intake coupled to said fan;

a cryogenic fluid transport module having a cryogenic fluid supply coupling and a cryogenic fluid dispensing coupling; and a controller operationally coupled to said transport module;

said controller including a programmable processor having computer readable program code embodied therein, the computer readable program code including instructions for:

receiving a temperature reading from a temperature probe;

comparing said temperature reading to a preselected temperature; and actuating said transport module to selectively feed cryogenic fluid from said source to said container;

coupling said cryogenic cooler with the modular shipping container;

coupling said supply coupling to a crygogenic fluid source; and selectively feeding cryogenic fluid from the source to the interior of the shipping container to maintain said interior at the super-frozen temperature.

35. A method for providing sushi-quality fish harvested at a first location, to a distinct second location, said method comprising:

freezing harvested fish at said first location to a super-frozen temperature of less than or equal to −45 degrees C.;

loading said fish, disposed at said super-frozen temperature, into an insulated shipping container, the shipping container including walls insulated to an r-value greater than or equal to 20;

charging the shipping container with a first cryogenic fluid, wherein said first cryogenic fluid is disposed into the container and onto the product;

sealing the shipping container to form a self-contained, dry module;

transporting the shipping container to said second location;

using a modular cryogenic cooler configured for maintaining the interior of the modular shipping container at the super-frozen temperature, the cooler including:

a fan;

an air intake coupled to said fan;

a cryogenic fluid transport module having a cryogenic fluid supply coupling and a cryogenic fluid dispensing coupling; and a controller operationally coupled to said transport module;

said controller including a programmable processor having computer readable program code embodied therein, the computer readable program code including instructions for:

receiving a temperature reading from a temperature probe;

comparing said temperature reading to a preselected temperature; and actuating said transport module to selectively feed cryogenic fluid from said source to said container;

coupling said cryogenic cooler with the modular shipping container;

coupling said supply coupling to a source of a second crygogenic fluid; and selectively feeding said second cryogenic fluid from the source to the interior of the shipping container to maintain said interior at the super-frozen temperature.

36. The method of claim 35 wherein said first cryogenic fluid includes liquid carbon dioxide and said second cryogenic fluid includes liquid nitrogen.

37. A method for providing an essentially unbroken delivery chain of super-frozen products at super-frozen temperatures of less than or equal to about −45 degrees C., from a location of freezing to a location of thawing, said method comprising:

using product disposed at the super-frozen temperature at a first location;

loading said product into a first insulated container;

shipping said first container from said first location to a second location;

coupling a cryogenic cooler configured for maintaining the interior of the container at the super-frozen temperature to said first container, said cooler including:

a fan;

an air intake coupled to said fan;

a cryogenic fluid transport module having a cryogenic fluid supply coupling and a cryogenic fluid dispensing coupling; and a controller operationally coupled to said transport module;

the controller including a programmable processor having computer readable program code embodied therein, the computer readable program code including instructions for:

receiving a temperature reading from a temperature probe;

comparing said temperature reading to a preselected temperature; and actuating said transport module to selectively feed cryogenic fluid from said source to said container;

transferring at least a portion of said super-frozen product from said first container to a second insulated container;

shipping said second container from said second location to a third location.

38. The method of claim 37 wherein said first container is a 40-foot ISO certified container.

39. The method of claim 37 wherein said second container is an LD3 ISO certified container.

40. The method of claim 37 wherein said product is fish.

41. The method of claim 37 wherein said first location is a location of harvest.

42. The method of claim 37 wherein said second location is selected from the group consisting of a distributor, a warehouse, a hub, and a wholesaler.

43. The method of claim 37 wherein said third location is a location of defrosting.

* * * * *